United States Patent [19]

Corbett

[11] Patent Number: 4,987,945

[45] Date of Patent: Jan. 29, 1991

[54] EVAPORABLE FOAM PATTERN ASSEMBLY FOR CASTING A CENTRIFUGAL PUMP HOUSING

[75] Inventor: William D. Corbett, Fond du Lac, Wis.

[73] Assignee: Brunswick Corporation, Skokie, Ill.

[21] Appl. No.: 443,904

[22] Filed: Nov. 30, 1989

[51] Int. Cl.[5] ..... B72D 7/02

[52] U.S. Cl. ..... 164/235; 164/34; 164/45

[58] Field of Search ..... 164/34, 35, 36, 45, 164/235, 246

[56] References Cited

U.S. PATENT DOCUMENTS 4,632,109 12/1986 Osborn et al. ..... 164/45
4,640,333 2/1987 Martin et al. ..... 164/246
4,657,063 4/1987 Morris ..... 164/45
4,777,997 10/1988 Corbett ..... 164/246
4,802,447 1/1989 Corbett ..... 164/45

OTHER PUBLICATIONS

"Evaporative Foam Casting Technology II Program", Nov. 1986.

*Primary Examiner*—Kuang Y. Lin
*Attorney, Agent, or Firm*—Andrus, Sceales, Starke & Sawall

[57] ABSTRACT

An evaporable foam pattern assembly for casting a centrifugal pump housing for an internal combustion engine. The assembly comprises three pattern sections having abutting surfaces joined by adhesives along a pair of parting lines. The parting lines are parallel and disposed normal to the axis of the impeller chamber of the pump.

16 Claims, 2 Drawing Sheets

EVAPORABLE FOAM PATTERN ASSEMBLY FOR CASTING A CENTRIFUGAL PUMP HOUSING

BACKGROUND OF THE INVENTION

Water pumps as used in a marine engine, have been traditionally produced by sand casting techniques. As a pump housing contains a number of chambers as well as openings for water flow and the drive connection, a complex sand casting pattern is required which includes a number of separate cores and core supports, thus resulting in a substantial cost for the cast pump housing.

Evaporable or lost foam casting processes have been used in the past to cast a variety of metal parts, particularly parts having thin wall sections or complex contours. With evaporable foam casting procedures, cores and core supports are eliminated, and the evaporable foam procedure provides smooth finished castings more attractive in appearance than those produced by sand casting.

In a typical evaporable foam casting process, a pattern is formed of a polymeric foam material, such as polystyrene or polymethylmethacrylate, having a shape or contour corresponding to the part to be cast. The polymeric foam pattern is placed in a mold and an unbonded flowable material, such as sand, is introduced into the mold surrounding the pattern and filling the cavities within the pattern. A molten metal is fed into the mold via a sprue and the heat of the metal will vaporize the polymeric foam material with the vapor being trapped within the interstices of the sand, while the molten metal will fill the void created by vaporization of the foam to provide a solidified metal casting corresponding in shape to the foam pattern.

SUMMARY OF THE INVENTION

The invention is directed to an evaporable foam pattern assembly for casting a pump housing and has particular application for casting a housing for a centrifugal water pump to be used in a marine engine. The assembled polymeric foam pattern comprises a housing including a pair of opposed outer walls as well as an annular internal wall that is spaced from the outer walls. One of the outer walls, in combination with the internal wall, defines an impeller chamber which is adapted to house the impeller in the cast metal pump, while the other of the outer walls in combination with the internal wall defines an inlet chamber which is connected via a central opening in the internal wall with the impeller chamber. The periphery of the inlet chamber communicates with an inlet opening and in the assembled pump, water is drawn in through the inlet opening and flows through the inlet chamber to the impeller chamber.

A discharge or outlet chamber communicates with the periphery of the impeller chamber and a pair of axially extending outlets communicate with the discharge chamber. In the assembled cast pump, liquid is discharged by the impeller through the discharge chamber to the outlets and then to the engine block of the engine.

In accordance with the invention, the polymeric foam housing pattern is composed of three pattern sections which have mating abutting surfaces joined together by an adhesive along a pair of parting lines which are parallel and disposed normal to the axis of the impeller chamber. The first of the parting lines extends through the inlet chamber and is located between one of the outer walls and the internal wall, while the second parting line extends through the impeller chamber and is located between the second outer wall and the internal wall.

In normal practice, the internal and external surfaces of a polymeric foam pattern are coated with a ceramic wash, and the pattern of the invention is designed so that the ceramic wash will freely enter and coat both the internal and external surfaces of the pattern and will fully drain therefrom.

In use, the pattern containing the ceramic wash coating is placed in an outer mold and an unbonded flowable material such as sand is introduced into the mold to surround the pattern and fill the cavities therein.

A molten metal, such as stainless steel, is introduced into the mold via a sprue and contacts the pattern. The heat of the molten metal will vaporize the polymeric material, with the resulting vapor being entrapped in the interstices of the sand, while the molten metal will fill the void created by vaporization of the foam to produce a metal casting having the identical shape of the foam pattern.

With the pattern construction of the invention, the sand which is introduced into the mold will readily fill the internal cavities of the pattern and can be readily removed from the cast housing after the casting operation has been completed.

The use of the polymeric foam pattern enables all of the cavities of the housing to be formed without the use of cores and core supports as are necessary in traditional sand casting techniques, thus producing a simpler and less expensive casting process.

Further, the use of the polymeric foam pattern produces a smoother finish on the outer surfaces of the casting which provides a more attractive appearance for the cast part.

Other obvious advantages will appear in the course of the following description.

DESCRIPTION OF THE DRAWINGS

The drawings illustrate the best mode contemplated of carrying out the invention.

In the drawings.

DESCRIPTION OF THE ILLUSTRATED EMBODIMENT

The drawings illustrate a polymeric foam pattern to be used in casting a metal pump housing and, in particular, a housing for a centrifugal water pump to be used in a marine engine. The housing 1 is formed of an evaporable foam material, such as polystyrene, polymethylmethacrylate, or the like.

Figure 3:
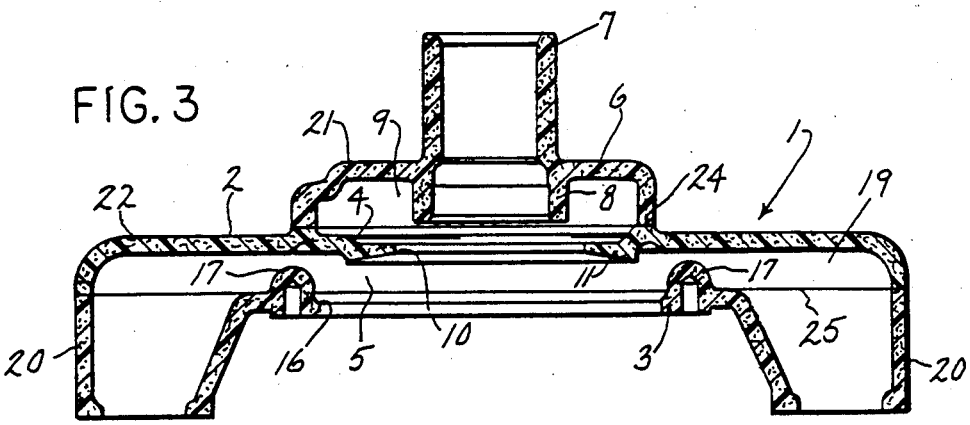
FIG. 3 is a section taken along line 3—3 of FIG. 1.
Figure 4:
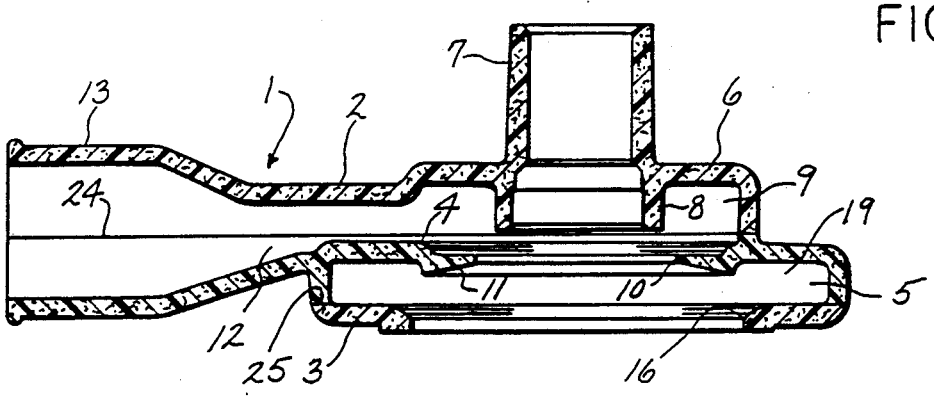
FIG. 4 is a section taken along line 4—4 of FIG. 1.
Figure 5:
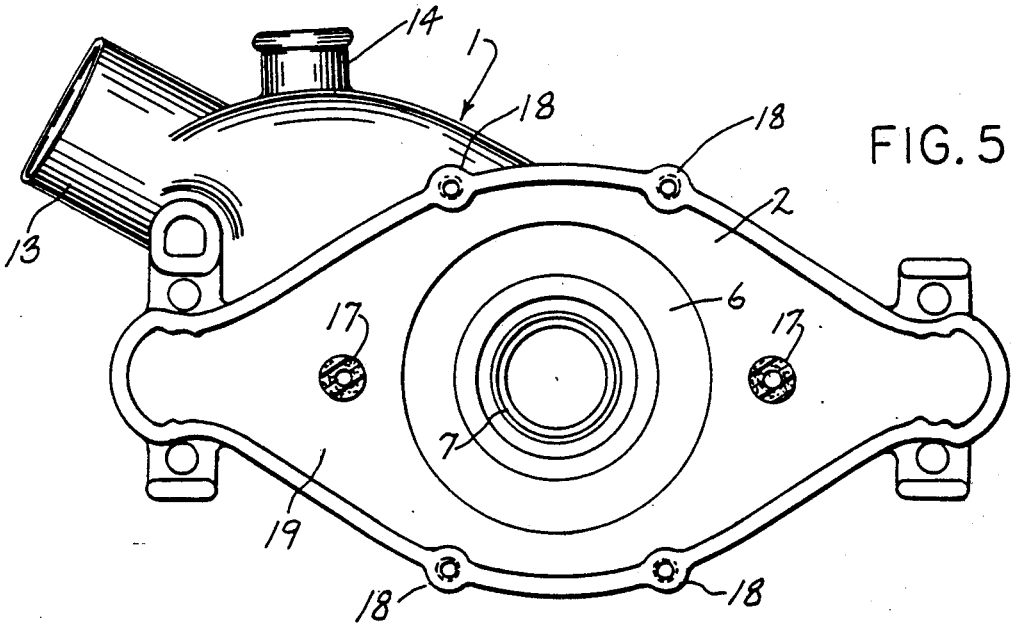
FIG. 5 is a section taken along line 5—5 of FIG. 2.
Figure 6:
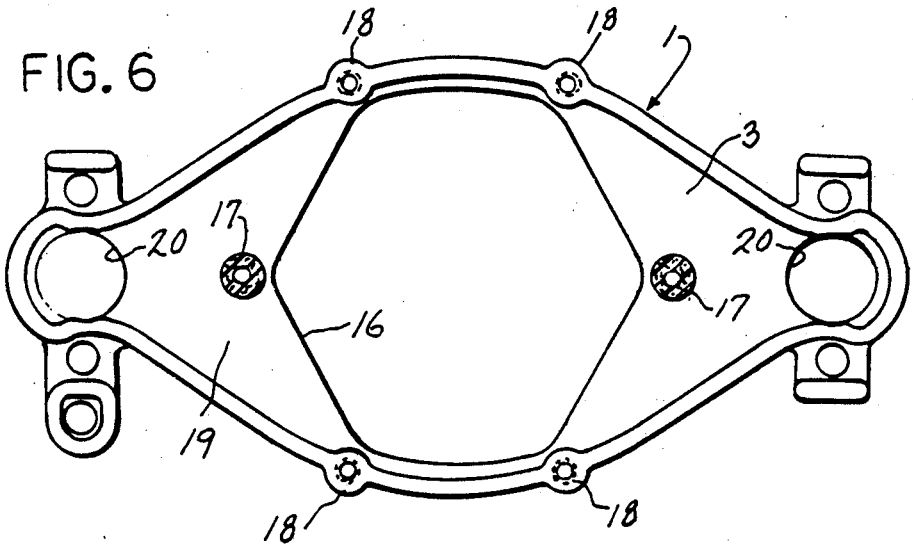
FIG. 6 is a section taken along line 6—6 of FIG. 2.

The assembled housing pattern 1 includes an outer wall 2 and an inner wall 3 and an annular internal wall 4 is connected to wall 1 as illustrated in FIGS. 3 and 4, and is spaced from inner wall 3. The space between inner wall 3 and internal wall 4 in the cast housing defines an impeller chamber 5.

The outer wall 2 is formed with an outwardly projecting hub portion 6 and an annular flange or sleeve 7 which extends outwardly from hub 6. The inner end of flange 7 communicates with a larger diameter internal annular flange 8, and in the cast housing, the aligned openings in flanges 7 and 8 receive the impeller shaft.

The area between internal wall 4 and hub 6 defines an inlet chamber 9 which communicates through the central opening 10 in internal wall 4 with the impeller chamber 5. As shown in FIGS. 3 and 4, the portion of internal wall 4 bordering opening 10 and facing the impeller chamber is inclined, as indicated by 11, and in the assembled pump, the surface 11 is in close tolerance to the impeller.

Figure 1:
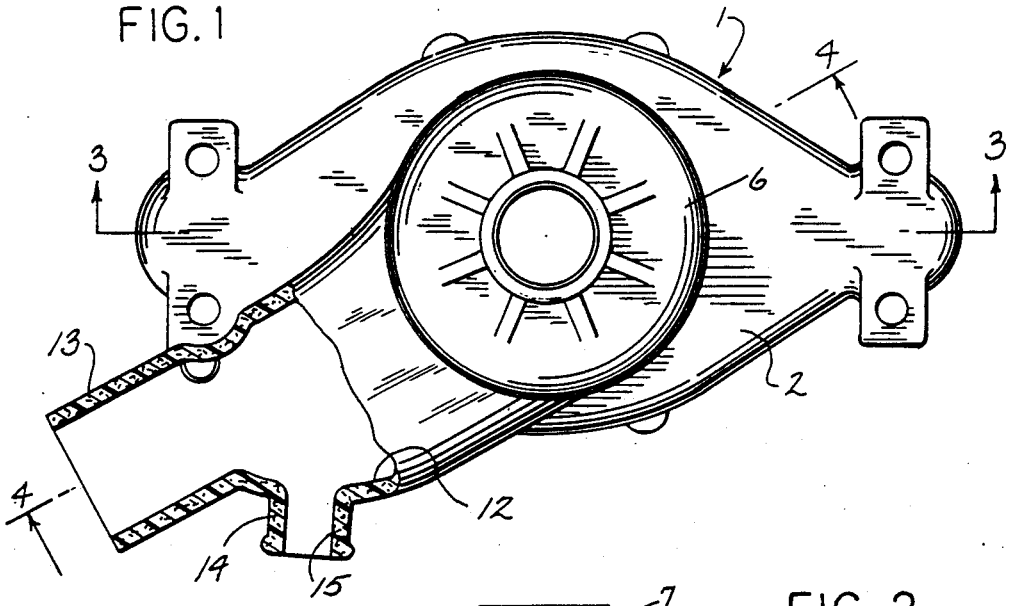
FIG. 1 is a plan view of the pattern assembly of the invention with parts broken away.
Figure 2:
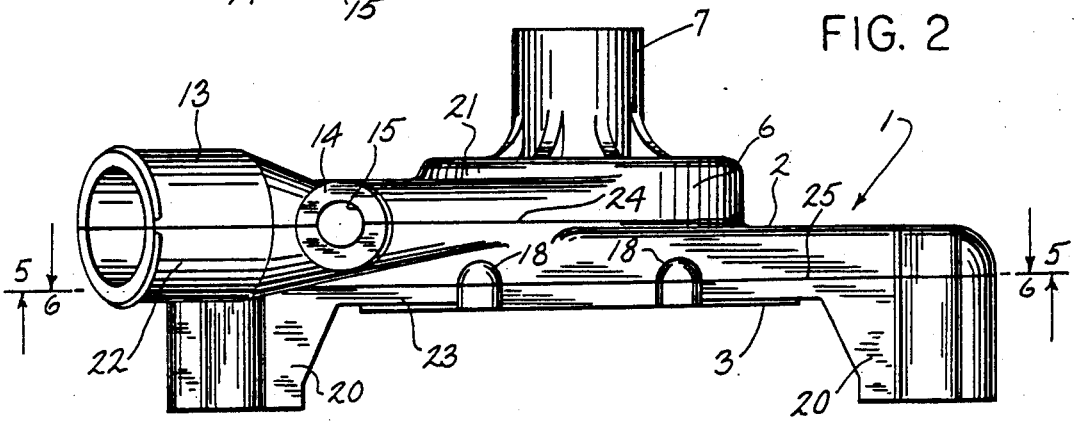
FIG. 2 is a side elevation of the pattern assembly.

As illustrated in FIG. 1, the outer wall 2 defines an inlet passage 12 which communicates with inlet chamber 9, and inlet passage 12 terminates in a cylindrical boss 13 which extends outwardly from the housing. In addition, the housing pattern is provided with a second boss 14 which borders a well 15 that communicates with inlet passage 12. In the assembled pump, a thermostat or water pressure switch can be mounted in the well 15 and will be in communication with the water entering the pump through the passage 12.

Inner wall 3 of the housing pattern 1 is provided with a central access opening 16 and in the cast housing the impeller is inserted into the housing through opening 16. In the assembled metal pump, a cover plate, not shown, is secured across the access opening 16. A pair of bosses 17 are formed on opposite sides of opening 16 and a series of bosses 18 are provided on the periphery of the housing. Bosses 17 and 18 define holes, which in the assembled cast pump, are threaded and receive screws to attach the cover plate to the housing.

A discharge chamber 19 is located radially outward of the impeller chamber 5 and a pair of outlets 20 communicate with discharge chamber 19. As best shown in FIG. 3, outlets 20 are disposed longitudinally of the axis of the impeller chamber 5 and are adapted to be connected water passages in the engine block of the engine.

In accordance with the invention, housing 1 is composed of three separate sections which consist of an outer pattern section 21, an intermediate section 22, and an inner section 23. Sections 21 and 22 have mating abutting surfaces which are joined together by a layer of glue or adhesive along a parting line 24. Similarly, section 22 and section 23 have abutting and mating surfaces which are joined together by an adhesive along parting line 25. Parting lines 24 and 25 are parallel to each other and are disposed normal to the axis of impeller chamber 5.

As illustrated in FIGS. 3 and 4, parting line 24 intersects inlet chamber 9 and is located adjacent the junction between hub 6 and outer wall 2. Flanges 7 and 8 are located wholly within the pattern section 21, while internal wall 4 is located in intermediate section 22.

Parting line 25 intersects the impeller chamber and the bosses 17 are located in the inner pattern section 23.

As previously noted, in the assembled pump, the impeller runs in close proximity to the inclined annular surface 11. With the pattern construction of the invention, the entire surface 11 is contained in pattern section 22 so that the surface 11 will be precisely located in proper tolerance with respect to the impeller. In addition, both of the outlets 20 are located in pattern section 23 so that the outlets are precisely located relative to each other and can be accurately aligned and connected to the water passages in the engine block.

The adhesive to be used in joining the pattern sections along the parting lines 24 and 25 is a conventional type used in evaporable foam processes. When exposed to the heat of the molten metal, the adhesive will vaporize, along with the pattern, without a residue which could mar or detract from the surface characteristics of the cast part.

In use of the pattern of the invention, both the internal and external surfaces of the assembled pattern are normally coated with a ceramic wash, and due to the construction of the pattern, the wash can readily contact both internal and external surfaces and drain from the surfaces.

In the casting procedure, the pattern 1 is placed in a mold and surrounded by a flowable finely divided material such as sand. Again, because of the construction of the pattern, the sand will readily flow into and fill all of the cavities of the pattern.

The pattern is connected to an evaporable foam sprue and when molten metal, such as stainless steel, is fed through the sprue, the heat of the molten metal will vaporize the evaporable foam pattern, as well as the adhesive, with the vapor being trapped in the interstices of the sand while the molten metal will fill the void created by vaporization of the pattern to produce a solidified metal casting identical in configuration to the pattern.

The use of the evaporable foam pattern simplifies the casting process in that it does not require cores or core supports. Further, the surface finish of the casting is smoother and more attractive than that which can be obtained through sand casting techniques.

Various modes of carrying out the invention are contemplated as being within the scope of the following claims particularly pointing out and distinctly claiming the subject matter which is regarded as the invention.

I claim:

1. An evaporable foam pattern assembly for use in casting a pump housing, comprising a housing pattern composed of polymeric foam material and including a pair of opposed outer walls and an annular internal wall disposed within the housing and spaced from said outer walls, the space between a first of said outer walls and said internal wall defining an impeller chamber and the space between the second of said outer walls and said internal wall defining an inlet chamber, said housing having a drive opening concentric with the axis of said impeller chamber and in communication with said impeller chamber, inlet means in said housing and communicating with said inlet chamber, outlet means in said housing and communicating with the periphery of said impeller chamber, said housing pattern comprising three pattern sections having abutting surfaces joined together along a pair of parting lines, said parting lines being parallel and disposed normal to the axis of said impeller chamber, one of said parting lines extending through said impeller chamber and located between said first outer wall and said internal wall and a second of said parting lines extending through said inlet chamber and located between said second outer wall and said internal wall, and joining means for joining the abutting surfaces of said pattern sections.

2. The assembly of claim 1, and including an annular flange extending inwardly from said second outer wall into said inlet chamber and bordering said drive opening, said flange disposed wholly in a first of said pattern sections.

3. The assembly of claim 1 wherein said joining means comprises an adhesive.

4. The assembly of claim 1, wherein said inlet means extends generally radially of said axis.

5. The assembly of claim 2, wherein said annular internal wall includes a central opening providing communication between said inlet chamber and said impeller chamber.

6. The assembly of claim 5, wherein the diameter of said opening is greater than the outer diameter of said flange.

7. The assembly of claim 1, wherein said first outer wall has an aperture disposed concentrically of said axis and communicating with said impeller chamber.

8. The assembly of claim 7, wherein said first outer wall is provided with a plurality of inwardly projecting bosses which are disposed radially outward of said aperture, said bosses being disposed wholly in one of said pattern sections.

9. The assembly of claim 1, wherein said outlet means comprises an outlet chamber extending radially from opposite sides of said impeller chamber.

10. The assembly of claim 9, wherein said outlet means also includes a pair of discharge openings communicating with said outlet chamber and facing longitudinally of said axis.

11. An evaporable foam pattern assembly for use in casting a pump housing, comprising a housing pattern composed of polymeric foam material and including a pair of opposed outer walls, an annular internal wall disposed within the housing, said internal wall being spaced from a first of said outer walls with the space defining an impeller chamber, said internal wall being spaced from a portion of said second outer wall with the space defining an inlet chamber, said housing having a drive opening concentric with the axis of said impeller chamber and in communication with said inlet chamber, an outlet chamber extending radially from opposite sides of said impeller chamber, a pair of discharge outlets connected to said outlet chamber and facing longitudinally of said axis, said pattern comprising three pattern section having abutting surfaces joined together along a first parting line and a second parting line, said parting lines being parallel and disposed normal to said axis, a first of said parting lines extending through said impeller chamber and located between said first outer wall and said internal wall and a second of said parting lines extending through said inlet chamber and located between said second outer wall and aid internal wall, said outlets being disposed in one of said pattern section, and said internal wall being disposed solely in a second of said pattern sections, and connecting means for connecting said abutting surfaces.

12. The assembly of claim 11, wherein said annular internal wall is provided with a central opening establishing communication between said inlet chamber and said impeller chamber.

13. The assembly of claim 11, and said connecting means comprises an adhesive.

14. An evaporable foam pattern assembly for use in casting a pump housing, comprising a housing pattern composed of polymeric foam material and including a pair of opposed outer walls, an annular internal wall disposed within the housing and spaced from a first of said outer walls to define an impeller chamber, said internal wall being connected to a second of said outer walls and spaced from a portion of said second outer wall to define an inlet chamber, said second wall having a drive opening concentric with the axis of said impeller chamber and in communication with said impeller chamber, said drive opening being bordered by an internal annular flange, inlet means in said housing and communicating with said inlet chamber, and outlet opening means in said housing and communicating with the periphery of said impeller chamber, said housing pattern comprising three pattern sections including a pair of an outer sections and an intermediate section, a first of said outer sections and said intermediate section having abutting surfaces joined together along a first parting line and a second of said outer sections and said intermediate section having abutting surfaces joined together along a second parting line, said parting lines being parallel and disposed normal to the axis of said impeller chamber, said first parting line extending through said impeller chamber and located between said first outer wall and said internal wall and said second parting line extending through said inlet chamber and located between said second outer wall and said internal wall, said flange being disposed solely in said second outer pattern section and said internal wall being disposed solely in said intermediate pattern section, and connecting means for connecting said abutting surfaces.

15. The assembly of claim 14, wherein said inlet chamber is annular in shape and surrounds said flange.

16. The assembly of claim 14 wherein said outlet means comprises a pair of discharge outlets located on opposite sides of said impeller chamber and facing longitudinally of said axis, said discharge outlets being disposed solely in said first pattern section.

* * * * *

UNITED STATES PATENT AND TRADEMARK OFFICE

CERTIFICATE OF CORRECTION

PATENT NO. : 4,987,945

DATED : January 29, 1991

INVENTOR(S) : WILLIAM D. CORBETT

It is certified that error appears in the above-identified patent and that said Letters Patent is hereby corrected as shown below:

CLAIM 11, column 5, line 47, delete "aid" and substitute therefor -- said --; CLAIM 14, column 6, line 26, after "of" delete "an".

Signed and Sealed this

First Day of September, 1992

*Attest:*

*Attesting Officer*

DOUGLAS B. COMER

*Acting Commissioner of Patents and Trademarks*